US008499836B2

(12) United States Patent
Moriarty et al.

(10) Patent No.: US 8,499,836 B2
(45) Date of Patent: Aug. 6, 2013

(54) ELECTRICALLY ACTIVATING A JARRING TOOL

(75) Inventors: Keith A. Moriarty, Houston, TX (US); Reinhart Ciglenec, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 410 days.

(21) Appl. No.: 11/973,918

(22) Filed: Oct. 11, 2007

(65) Prior Publication Data

US 2009/0095490 A1 Apr. 16, 2009

(51) Int. Cl.
*E21B 31/113* (2006.01)

(52) U.S. Cl.
USPC ..... 166/301; 166/178; 175/296

(58) Field of Classification Search
USPC ..... 166/301, 178; 175/293–306
See application file for complete search history.

(56) References Cited

U.S. PATENT DOCUMENTS

| | | | | |
|---|---|---|---|---|
| 2,091,680 | A | 8/1937 | Greenlee | |
| 3,227,214 | A | 1/1966 | Whann | |
| 3,302,736 | A * | 2/1967 | Kisling, III | 175/297 |
| 4,161,224 | A * | 7/1979 | Hostrup | 175/297 |
| 4,566,546 | A * | 1/1986 | Evans | 175/297 |
| 5,086,853 | A * | 2/1992 | Evans | 175/297 |
| 5,228,507 | A | 7/1993 | Obrejanu et al. | |
| 5,318,139 | A * | 6/1994 | Evans | 175/297 |
| 5,398,753 | A * | 3/1995 | Obrejanu et al. | 166/98 |
| 5,447,196 | A * | 9/1995 | Roberts | 166/178 |
| 5,595,244 | A * | 1/1997 | Roberts | 166/178 |
| 5,931,242 | A * | 8/1999 | Oettli | 175/296 |
| 6,037,682 | A * | 3/2000 | Shoop et al. | 310/26 |
| 6,290,004 | B1 * | 9/2001 | Evans | 175/296 |
| 6,394,184 | B2 * | 5/2002 | Tolman et al. | 166/281 |
| 6,481,495 | B1 | 11/2002 | Evans | |
| 6,655,460 | B2 * | 12/2003 | Bailey et al. | 166/301 |
| 6,729,419 | B1 | 5/2004 | Lee | |
| 6,866,096 | B2 | 3/2005 | Tillett, Jr. | |
| 6,896,060 | B2 | 5/2005 | Tillett, Jr. | |
| 6,988,551 | B2 | 1/2006 | Evans | |

(Continued)

FOREIGN PATENT DOCUMENTS

| | | |
|---|---|---|
| CN | 200940461 | 8/2007 |
| CN | 201173100 | 12/2008 |
| WO | 03033859 A1 | 4/2003 |

OTHER PUBLICATIONS

Espacenet—Bibliographic Data of English Abstract of CN200940461, 1 page.

(Continued)

*Primary Examiner* — Kenneth L Thompson
*Assistant Examiner* — Blake Michener
(74) *Attorney, Agent, or Firm* — Michael Flynn; Jody DeStefanis; Robin Nava

(57) ABSTRACT

A method of using jarring tool in a wellbore, where the jarring tool is electrically activated to apply an impact force transmitted to at least another tool in the well. The method may further comprise operating a hydraulic mechanism in response to electrical activation of the jarring tool to cause a first member of the jarring tool to be moved to collide with a second member of the jarring tool to apply the impact force. Also, the method may involve electrically activating the jarring tool by communicating at least one command over at least one electrical conductor to the jarring tool.

18 Claims, 6 Drawing Sheets

U.S. PATENT DOCUMENTS

| | | | | |
|---|---|---|---|---|
| 7,025,130 | B2 * | 4/2006 | Bailey et al. | 166/65.1 |
| 7,111,678 | B2 | 9/2006 | McElroy | |
| 2003/0075329 | A1 * | 4/2003 | Day et al. | 166/301 |
| 2004/0108108 | A1 * | 6/2004 | Bailey et al. | 166/242.6 |
| 2005/0150693 | A1 * | 7/2005 | Madden | 175/298 |
| 2009/0166026 | A1 * | 7/2009 | Akselberg | 166/178 |
| 2009/0194285 | A1 * | 8/2009 | Redlinger et al. | 166/301 |
| 2009/0266544 | A1 * | 10/2009 | Redlinger et al. | 166/298 |

OTHER PUBLICATIONS

Espacenet—Bibliographic Data of English Abstract of CN201173100, 1 page.

Chinese Office Action issued in Chinese Application Serial No. 200810094859.8 on Aug. 1, 2012 with English Translation, 7 pages.

International Search Report issued in PCT/IB2008/054111 on May 29, 2009, 3 pages.

* cited by examiner

ELECTRICALLY ACTIVATING A JARRING TOOL

TECHNICAL FIELD

The invention relates generally to electrically activating a jarring tool.

BACKGROUND

The statements in this section merely provide background information related to the present disclosure and may not constitute prior art.

Various operations can be performed in a well using tool strings that are run into the well on a carrier structure such as a wireline, slickline, coiled tubing, jointed tubing, drill pipe, and so forth. In some cases, the tool strings can be stuck in the wellbore, with the well operator unable to apply sufficient tensile force through the carrier structure to free the stuck tool string.

To free a tool string that is stuck in a wellbore, a jarring tool is typically provided in the tool string. The jarring tool is able to apply an impact force that amplifies tension applied to the carrier structure. The amplified impact force is transmitted to other tools in the tool string to which the jarring tool is coupled so that the tool string can be freed.

Typically, jarring tools are actuated using either a hydraulic mechanism or a mechanical mechanism. A hydraulic mechanism can include a hydraulic metering device that allows for provision of a time delay when the jarring tool is actuated by application of tension on the carrier structure. A conventional mechanical mechanism typically includes a spring/collet assembly that is activated by application of tension on the carrier structure.

Conventional jarring tools rely exclusively on application of tension over the carrier structure to initiate and control the intensity and timing of the jarring force. This can be difficult in deviated or horizontal wells, where friction between the carrier structure and the side of the wellbore can prevent proper control of actuation of the jarring tool. Also, conventional jarring tools are subject to variability of operation and control due to varying downhole conditions in the wellbore.

SUMMARY

In general, a method comprises electrically activating a jarring tool to apply an impact force that is transmitted to at least another tool in a wellbore.

In some aspects, the invention is a method using jarring tool in a wellbore, where the jarring tool is electrically activated to apply an impact force transmitted to at least another tool in the well. The method may further involve operating a hydraulic mechanism in response to electrical activation of the jarring tool to cause a first member of the jarring tool to be moved to collide with a second member of the jarring tool to apply the impact force. Also, the method may involve electrically activating the jarring tool by communicating at least one command over at least one electrical conductor to the jarring tool.

In other aspects, the method further includes operating a hydraulic mechanism in response to electrical activation of the jarring tool to cause a first member of the jarring tool to be moved to collide with a second member of the jarring tool to apply the impact force. In one embodiment, this involves operating the hydraulic mechanism by opening a solenoid valve in the hydraulic mechanism in response to electrical activation of the jarring tool, where by opening the solenoid valve allows for hydraulic fluid to flow between chambers of the jarring tool to allow movement of the first member.

The jarring tool may have a first assembly and a second assembly that are slidable with respect to each other, wherein the first assembly and second assembly are initially in a retracted position, and wherein opening of the solenoid valve allows the first assembly to retract away from the second assembly. Jarring tools may also include one or more electronic control modules responding to the electrical activation by operating the hydraulic mechanism.

In some embodiments, by providing a mechanical mechanism that is actuated in response to electrical activation of the jarring tool, the first member of the jarring tool collides with a second member of the jarring tool to apply sufficient impact force. The mechanical mechanism may have an actuator with a locking member to initially lock the actuator in a first position, where electrical activation of the jarring tool causes the locking mechanism to be released to allow for movement of the actuator, wherein the first member is part of the actuator.

The methods of the invention may include applying a tensile force on a carrier structure attached to a tool string that includes the jarring tool, where the electrical activation of the jarring tool is done after application of the tensile force on the carrier structure. The tensile force may determine a magnitude of the impact force applied by the jarring tool. Also, applying the tensile force may include applying a tensile force selected from plural possible tensile forces, where the selected tensile force is based on a target impact force to be applied by the jarring tool.

Jarring tools useful in some embodiments of the invention may include an external housing and an inner bore that includes an operating piston, the first member including the operating piston, and electrically activating the jarring tool causes the piston to move inside the inner bore of the jarring tool to impact an impact surface of the outer housing. An energy storage source may be located within the jarring tool, and the energy storage source is used to provide application of force on the operating piston to move the operating piston. In some aspects, the energy storage source includes a spring and a gas charged accumulator, as well as an optional motor and pump assembly to compress the spring.

For some jarring tools, the inner bore has a first portion having a first diameter and a second portion having a second, greater diameter, wherein the operating piston is positioned in the portion of the inner bore with the first diameter prior to activation of the jarring tool. The operating piston may be moved into the portion of the inner bore having the second diameter during activation of the jarring tool such that bypass of fluids is enabled around the operating piston to accelerate a speed of movement of the operating piston. In other jarring tools, a floating piston is located within the inner bore of the external housing, and provides compensation for fluid expansion or contraction due to variation in temperature and pressure.

Methods and apparatus according to the invention may include electrically activating the jarring tool is in response to optical signals communicated over a fiber-optic signal line, and/or electrical signals communicated over an electrical conductor.

Some jarring tools according to the invention include a module responsive to electrical activation, a first member moveable in response to signaling from the module that is responsive to the electrical activation, and an impact member against which the first member collides to apply an impact force that is transmitted to at least one other tool for jarring the at least one other tool. In some aspects, movement of the first member is enabled by a tensile force applied to a carrier structure to which the jarring tool is coupled. The jarring tools may further a housing in which the first member is moveably positioned, where the first member divides the inner bore into a first chamber and a second chamber, and a hydraulic mechanism to enable communication of fluid between the first and second chambers to allow movement of the first member in the inner bore.

Also provided herein is tool string for use in a wellbore which includes a first tool and a jarring tool coupled to the first tool, the jarring tool responsive to electrical activation by applying an impact force that is communicated to the first tool to free the first tool from a stuck position in the well. Such tool string may include a carrier structure coupled to the first tool and jarring tool, wherein prior to activation of the jarring tool, a tensile force is applied to the carrier structure, wherein the tensile force applied to the carrier structure defines the impact force applied by the jarring tool.

Other or alternative features will become apparent from the following description, from the drawings, and from the claims.

DETAILED DESCRIPTION

In the following description, numerous details are set forth to provide an understanding of the present invention. It should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure, and that numerous variations or modifications from the described embodiments are possible. Further, the description and examples are presented solely for the purpose of illustrating the preferred embodiments of the invention and should not be construed as a limitation to the scope and applicability of the invention.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a jarring tool that is electrically activated is provided to enable application of an impact force that is transmitted to at least another tool coupled to the jarring tool in a well. Electrical activation can involve communication of one or more electrical commands to the jarring tool, where the communication of the one or more electrical commands can be precisely controlled by an operator at the surface. In response to the electrical command(s), the jarring tool initiates an actuation mechanism that causes a first member of the jarring tool to collide with a second member of the jarring tool to apply an impact force. Movement of the first member is caused at least partially by a tensile force applied to a carrier structure coupled to a tool string that includes the jarring tool. The applied impact force is transmitted to one or more other tools that are coupled to the jarring tool to allow such one or more other tools to be freed if such one or more other tools are stuck in the well. The impact force applied by the jarring tool includes a sudden release of kinetic energy in the axial direction of the jarring tool that is initiated or triggered by the electrical command(s).

The following describes various example embodiments. Note that the following examples are provided for purposes of illustration as other embodiments having differing configurations can also be provided.

Figure 1:
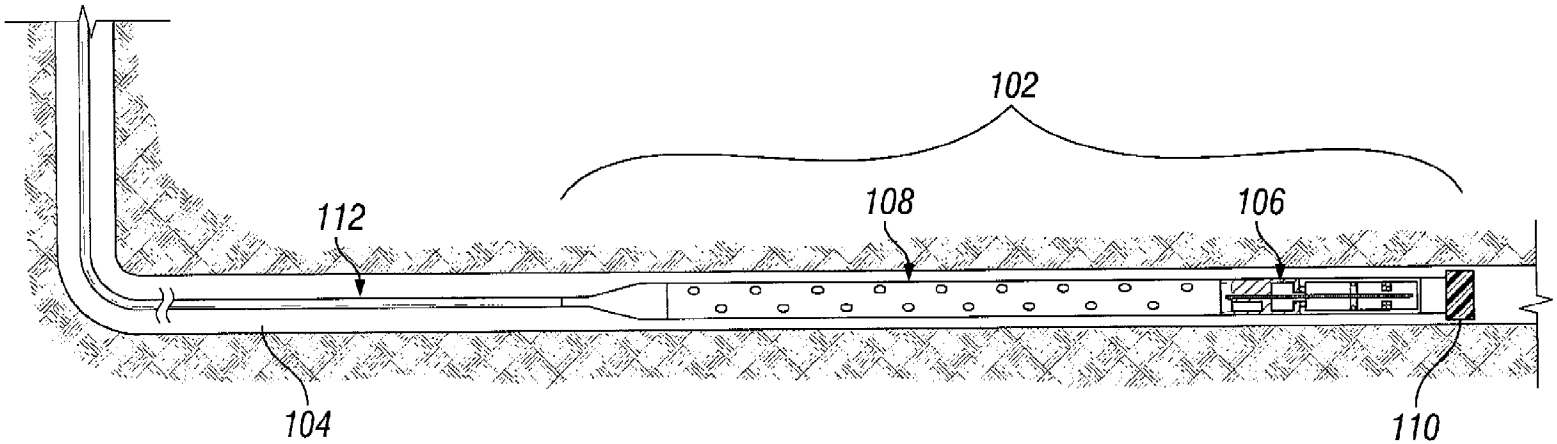
FIG. 1 illustrates a wireline-conveyed tool string provided in a wellbore that includes a jarring tool according to an embodiment.

FIG. 1 illustrates a tool string 102 that is deployed in a wellbore 104, where the tool string has a jarring tool 106 and other tools, such as a perforating gun 108 and a sealing packer 110. In other examples, other or alternative types of tools can be part of the tool string 102.

The tool string 102 is attached to a carrier structure 112, which in one example can be a wireline as illustrated in FIG. 1. In other examples, other types of carrier structures can be used, including a slickline, seismic cable, coiled tubing, jointed tubing, drill pipe, composite coiled tubing, and so forth, and in some embodiments on the condition that they have provisions for electrical conductors, or electrical signal and/or fiber-optic signal lines (e.g., wired drill pipe, etc.). If fiber-optic signal lines are used that extend from the earth surface to the tool string 102, then fiber-optic control can be performed based on optical signals communicated through the fiber-optic signal lines.

In the example of FIG. 1, the tool string 102 is deployed in a deviated section of the wellbore 104. Note that the jarring tool 106 according to some embodiments can also be used to apply jarring force to a tool string that is located in a vertical section of a wellbore.

Figure 2:
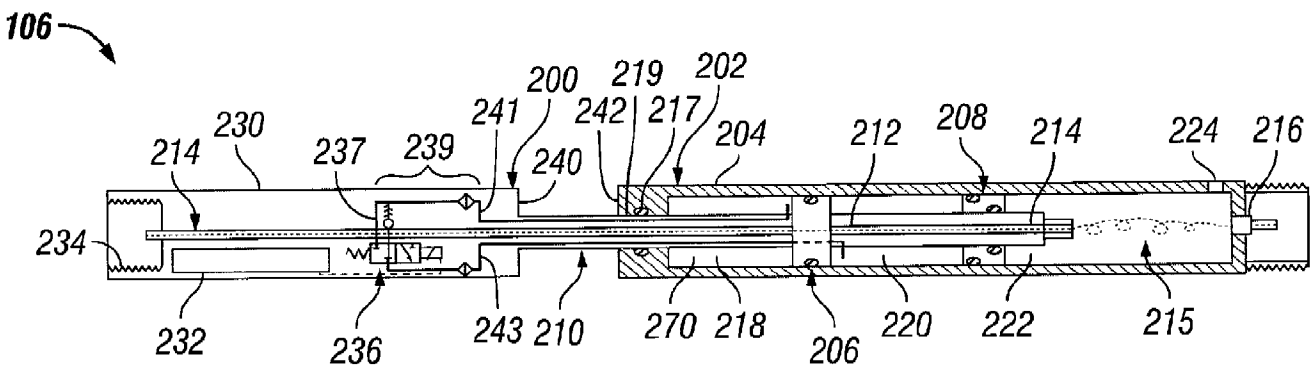
FIG. 2 shows a jarring tool according to an embodiment.

Details of one embodiment of the jarring tool 106 are depicted in FIG. 2. Generally, the jarring tool 106 of FIG. 2 operates by opening a valve in response to an electrical command (such as an electrical command communicated over the carrier structure 112) that allows for rapid movement of a piston/rod assembly until there is impact of mechanical surfaces in the jarring tool. Prior to application of the electrical command to the jarring tool 106, a tensile force is applied on the carrier structure 112, such as by pulling on the carrier structure 112 at the earth surface to store potential energy in the carrier structure 112. Note that the pulling of the carrier structure 112 at the earth surface does not result in movement of the tool string 102 that is stuck in the wellbore 104. For example, the tool string 102 may be stuck due to the packer or other tool of the tool string 102 being stuck. The magnitude of the impact force applied by the jarring tool 106 in response to the electrical command is dependent on the amount of tensile force applied to the carrier structure 112.

As depicted in FIG. 2, the jarring tool 106 has a jar mandrel assembly 200 and a jar cylinder assembly 202 that are moveable with respect to each other. The jar cylinder assembly 202 has an external housing 204 that defines an inner space (which can be a generally cylindrical bore in one implementation). Provided inside the cylindrical bore of the external housing of the jar cylinder assembly 202 are an operating piston 206 and a compensation piston 208, which are moveable in the cylindrical bore. Piston 206 is attached to a rod assembly 210.

Piston 208 is free to slide on rod assembly 210 within the bore of external housing 204 in order to provide pressure and temperature compensation from hydrostatic pressure exerted by fluid present in wellbore 104 and expansion of jar operating fluid (e.g., oil) from high downhole temperatures in the wellbore 104. In the example embodiment depicted in FIG. 2, the rod assembly 210 has an inner longitudinal bore 212 through which one or more electrical conductors 214 can be provided. In this manner, through-wire conductor(s) 214 can be provided through the jarring tool 106 such that the through-wire conductors can electrically connect tools attached to the two ends of the jarring tool 106. As depicted in FIG. 2, at the lower end of the jarring tool 106, the conductor(s) 214 is (are) electrically connected to an electrical connector 216 that is in turn connected to another tool.

Three chambers are defined by the pistons 206 and 208, including a first chamber 218 that contains a jar operating fluid (e.g., oil), a second chamber 220 that initially contains a jar operating fluid (e.g., oil), and a third chamber 222 that contains wellbore fluid (e.g., completion fluid, production fluid, oil, gas, drilling mud, etc.) communicated through a port 224 in the external housing 204 of the jar cylinder assembly 202. The outer surfaces of the pistons 206, 208 are provided with seals (e.g., O-ring seals) to allow the outer surfaces of the pistons 206, 208 to sealingly engage the inner side wall of the external housing 204.

The operating piston 206 is moveable with and coupled to the rod assembly 210 in the cylindrical bore of the jar cylinder assembly housing 204 to allow the operating piston 206 to collide with another member of the jar cylinder assembly, in this example an impact shoulder 270 provided at an upper inner end of the housing 204. The compensation piston 208 is a floating piston that allows for pressure and temperature compensation with the wellbore fluids. The compensation piston 208 is moved as fluid expands or contracts due to temperature/pressure variations in the wellbore. The compensation piston 208 is slidable along the rod assembly 210, but the operating piston 206 is fixedly attached to the rod assembly 210.

The rod assembly 210 is fixedly attached to the jar mandrel assembly 200 such that the rod assembly 210 moves with the jar mandrel assembly 200. However, the rod assembly 210 is moveably engaged with the jar cylinder assembly 202. As depicted in FIG. 2, the rod assembly 210 extends through an opening 219 in a top part of the jar cylinder assembly housing 204 into the cylindrical bore. A seal 217 is provided around the rod assembly 210 in the opening 219 to provide sealing engagement between the rod assembly 210 and the housing 204.

Figure 3:
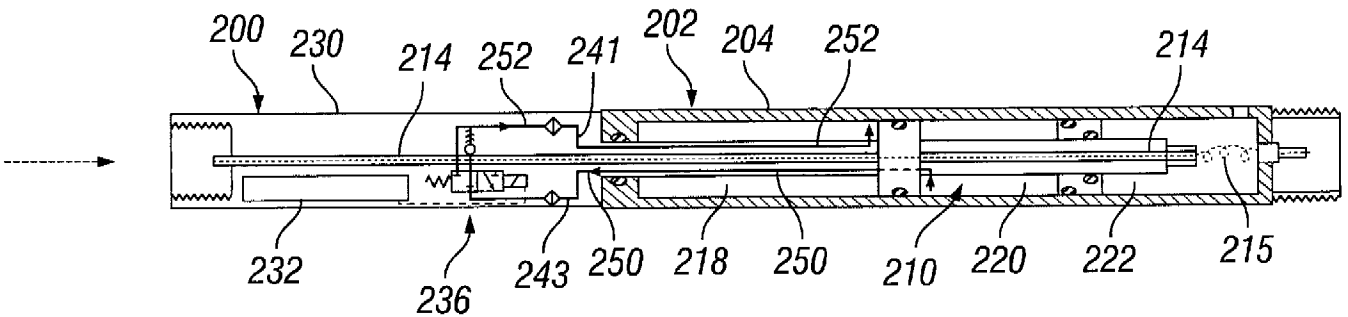
FIGS. 3-6 illustrate operation of the jarring tool of FIG. 2.

The arrangement depicted in FIG. 2 allows the jar mandrel assembly 200 to extend away from the jar cylinder assembly 202 (as depicted in FIG. 2) or to be compressed towards the jar cylinder assembly 202 (as depicted in FIG. 3).

The jar mandrel assembly 200 includes an external housing 230 that defines an inner space in which various components are provided. The external housing 230 has a connection profile 234 to allow for connection of the jarring tool 106 to another tool above the jarring tool 106. The various components inside the jar mandrel assembly 200 include an electronic control module 232 that is electrically connected to the through-wire conductor(s) 214. The electronic control module 232 is able to receive electrical signaling (e.g., commands) that are communicated over the through-wire conductor(s) 214 to activate a hydraulic mechanism 239 in the jar mandrel assembly 200 that controls the flow of fluid across the operating piston 206 of the jar cylinder assembly 202.

The hydraulic mechanism 239 that is activated by the electronic control module 232 includes a solenoid valve 236 that can be opened and closed in response to signals from the electronic control module 232. As discussed further below, opening of the solenoid valve 236 allows for the flow of fluid from the first chamber 218 to the second chamber 220 such that the jarring tool 106 can be actuated to apply an impact force.

The hydraulic mechanism 239 also includes a check valve 237 that allows flow of fluid in one direction but not the reverse direction in the hydraulic mechanism 239. The hydraulic mechanism 239 has hydraulic conduits 241 and 243 that are in fluid communication with conduits that extend through the rod assembly 210 to the chambers 218 and 220, respectively. Fluid flows through the conduits between the chambers 218, 220 along the various conduits as discussed further below.

Operation of the jarring tool 106 is discussed in connection with FIGS. 3-6. To set the jarring tool 106, the weight of the tool string exerts a downward force on the jar mandrel assembly 200 as indicated by the arrow, which causes the operating piston 206 and the rod assembly 210 to move downwardly in the cylindrical bore of the jar cylinder assembly 202, as depicted in FIG. 3. In this setting operation, oil in the jarring tool 106 flows from the second chamber 220 to the first chamber 218 through conduits in the rod assembly and through the hydraulic mechanism 239. Note that the solenoid valve 236 is closed at this time. The oil flows from the second chamber 220 along path 250 through the rod assembly 210 and to the hydraulic conduit 243 of the hydraulic mechanism 239. The fluid continues through the check valve 237 and exits the check valve 237 as fluid flow 252 in the hydraulic conduit 241 of the hydraulic mechanism 239. The fluid flow 252 continues through a conduit of the rod assembly 210 and enters the first chamber 218.

Such flow of oil from the second chamber 220 to the first chamber 218 allows for movement of the operating piston 206 and rod assembly 210 downwardly. Downward motion continues until the lower end 240 of the jar mandrel assembly housing 230 comes into contact with the upper end 242 of the jar cylinder assembly housing 204, as depicted in FIG. 3. At this point, the jarring tool is in its retracted position and is hydraulically locked so that no extension of the jarring tool will occur until activation.

Figure 4:
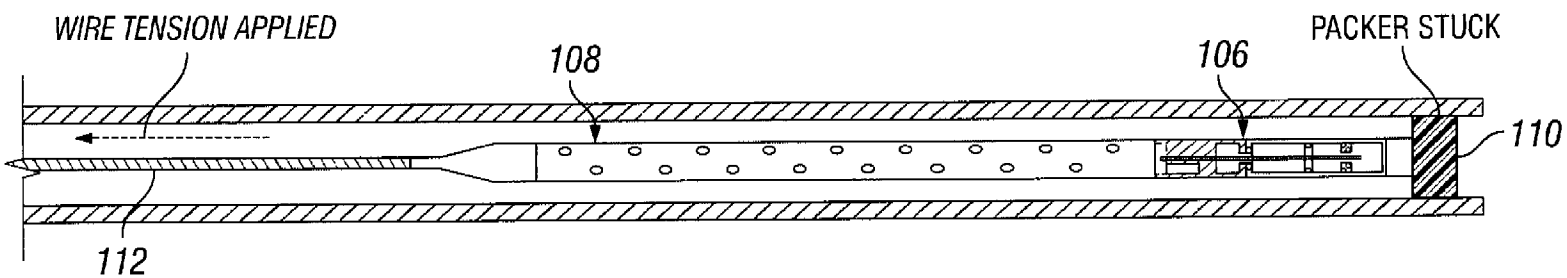

At some later time, the tool string 102 may become stuck in the wellbore. This is illustrated in the example of FIG. 4, where the packer 110 is depicted as being stuck against the wall of the wellbore (note that the wall of the wellbore can actually be the wall of a liner or casing that lines the wellbore). This is only one example of a stuck condition. There are many variants of stuck conditions, mechanisms, and environments, such as open hole sticking caused by excess differential pressure between the annulus and formation, mechanical sticking from debris, cuttings, hole collapse, etc.

Once the well operator at the earth surface detects that the tool string 102 is stuck, the well operator can apply a tensile force on the carrier structure 112, such as by rotating a spool or winch, or operation of draw-works of a rig, etc., at the earth surface on which the carrier structure 112 is mounted or coupled. This tensile force pulls on the carrier structure 112 without moving the tool string 102, which is stuck. By applying the tensile force on the carrier structure 112, potential energy is stored in the carrier structure 112. This potential energy will be used to control the magnitude of the impact force applied by some embodiment of the jarring tool 106 when the jarring tool is activated. According to some embodiments, since the jarring tool 106 is electrically activated, the well operator can select the amount of tensile force applied on the carrier structure 112 to adjust the desired impact force to be applied by the jarring tool 106. This provides flexibility since the impact force can be adjusted according to a setting desired by the well operator. In other words, the operator is not limited to just one or a small number of finite preset tensile force(s) on the carrier structure 112, but instead, the well operator can apply a wide range of different tensile forces on the carrier structure 112 according to the impact force that is needed.

To initiate activation of the jarring tool 106, one or more commands are sent from the earth surface through the carrier structure (e.g., through one or more conductors in the carrier structure 112) to the electronic control module 232 in the jarring tool 106. In response to the electrical command(s), the electronic control module 232 opens the solenoid valve 236 in the jar mandrel assembly 200. Under the applied tension on the carrier structure 112, the higher pressure oil flows rapidly from the first chamber 218 to the second chamber 220, resulting in rapid movement and extension of the jar mandrel assembly 200 from the jar cylinder assembly 202.

Figure 5:
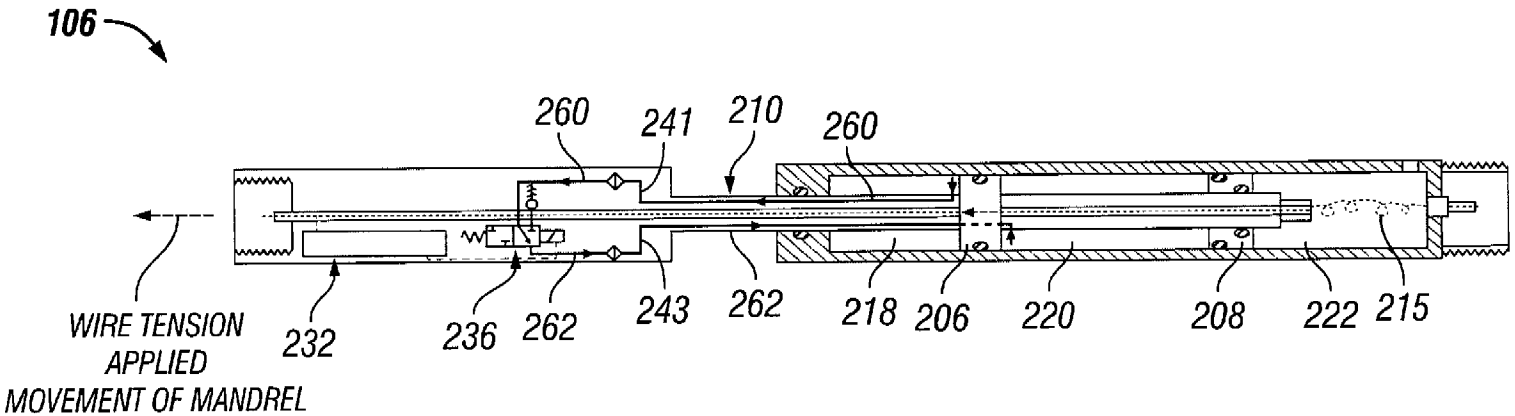

The movement of the jar mandrel assembly 200 away from the jar cylinder assembly 202 is depicted in FIG. 5, which shows a mid-stroke position of the jarring tool 106 after activation. Since the solenoid valve 236 is open, and since the first chamber 218 contains higher pressure oil, the fluid flows from the first chamber 218 along path 260 in a conduit of the rod assembly 210 to the hydraulic conduit 241 of the hydraulic mechanism 239. The flow 260 continues through the open solenoid valve 236 and exits the solenoid valve 236 as flow 262. The flow 262 continues through the hydraulic conduit 243 and another conduit in the rod assembly 210, passing through the operating piston 206 to the second chamber 220, which contains lower pressure oil.

Since the piston and rod assembly areas are constant, there is relatively little movement in the compensation piston 208 with respect to the external housing 204 of the jar cylinder assembly 202, which results in an exchange of oil mainly between the first and second chambers 218 and 220 with the rod assembly 210 moving within the compensation piston 208.

Figure 6:
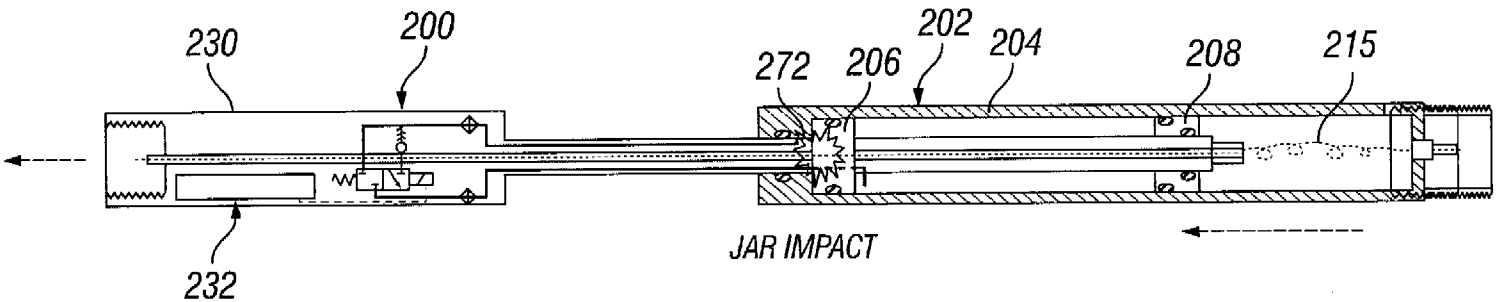

As the jar mandrel assembly 200 fully and rapidly extends away from the jar cylinder assembly 202, there is a sudden impact of the operating piston 206 on the impact shoulder 270 inside the jar cylinder assembly housing 204. The impact (272) is illustrated in FIG. 6. Depending on the tension applied on the carrier structure 112, and the configuration of the jarring tool 106 (e.g., stroke length, hydraulic flow area, speed, mass, and so forth), an amplified impact force can be generated at the contact surface between the operating piston 206 and the impact shoulder 270 of the jar cylinder assembly housing 204. The amplified force is transmitted through the jar cylinder assembly housing 204 to other tools coupled to the jarring tool 106, including the example of the stuck sealing packer 110 that is depicted in FIG. 4.

As depicted in each of FIGS. 2, 3, 5, and 6, a section 215 of the through-wire conductor(s) 214 is coiled such that the conductor(s) 214 can be extended due to extension of the jar mandrel assembly 200 and the rod assembly 210 away from the jar cylinder assembly 202. The coiled section 215 of the conductor(s) 214 is provided in the third chamber 222 of the jar cylinder assembly 202. Note that coiled section 215 is just one method to enable through-wire continuity under jar movement, extension and compression and there are other flexible conductor arrangements possible that are not shown.

In the embodiment depicted in FIGS. 2, 3, 5, and 6, the inner diameter of the jar cylinder assembly housing 204 is relatively constant along a length over which the operating piston 206 moves during activation of the jarring tool 106. Thus, in such embodiment, the communication of fluid between the first and second chambers 218 and 220 relies on conduits in the rod assembly 210 and the hydraulic mechanism 239. In a different embodiment, if even faster communication of fluids between the first and second chambers 218 and 220 is desired during activation of the jarring tool 106, an upper portion of the jar cylinder assembly housing 204 can have an inner diameter D2 that is larger than an inner diameter D1 in another portion of the jar cylinder assembly housing 204. The portion with the larger diameter D2 is referred to as an "enlarged portion" of the jar cylinder assembly housing 204 and allows disengagement of a seal on piston 206 from the jar cylinder assembly housing 204.

Figure 7:
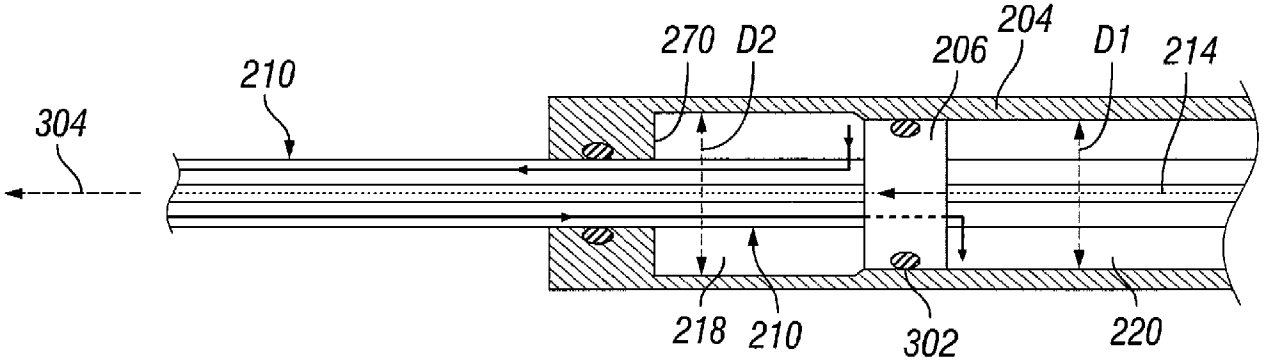
FIGS. 7-8 illustrate a portion of a jarring tool according to another embodiment.
Figure 8:
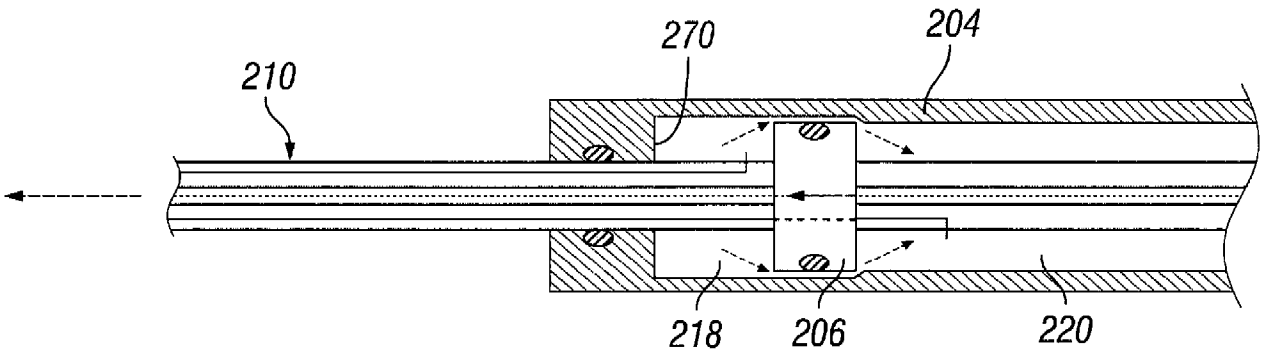

As depicted in FIG. 7, the operating piston 206 is initially sealably engaged (due to presence of an O-ring seal 302, for example) with the inner wall of the jar cylinder assembly housing 204 in a portion that has the smaller inner diameter D1. During activation, when the operating piston 206 is moved upwardly in the direction pointed by arrow 304 in FIG. 7, the operating piston 206 enters the enlarged portion of the cylindrical bore that has the larger inner diameter D2, as depicted in FIG. 8. This provides a bypass path around the outer diameter of the operating piston 206 such that fluid can flow directly around the piston 206 between the chambers 218 and 220. Thus, when the operating piston 206 enters the enlarged portion of the cylindrical bore (having inner diameter D2), hydraulic resistance is abruptly reduced and the speed of the operating piston 206 and rod assembly 210 is accelerated to result in a higher impact force between the operating piston 206 and the impact shoulder 270 of the jar cylinder assembly housing 204.

Figure 9:
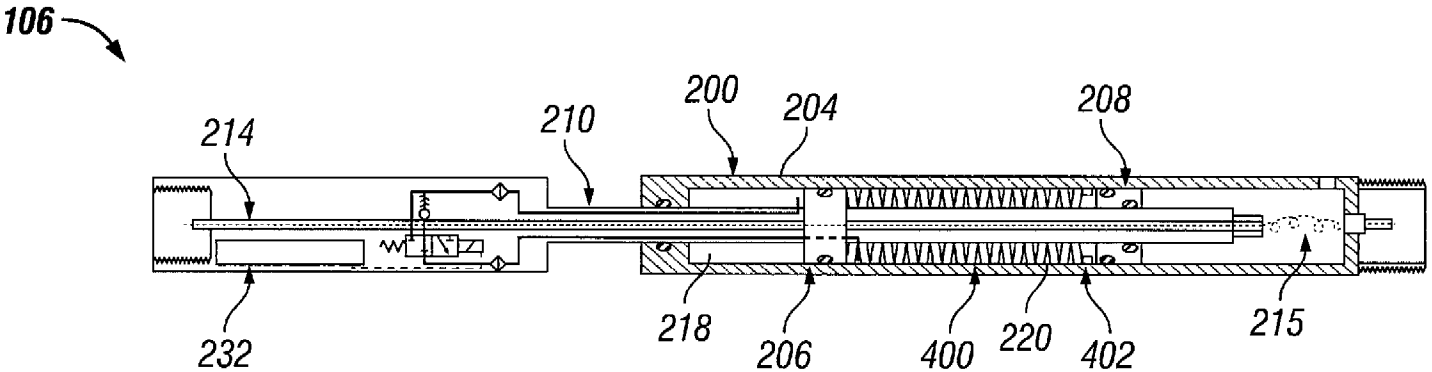
FIGS. 9-13 illustrate jarring tools according to other embodiments.

FIG. 9 shows yet another example embodiment, in which a spring 400 is provided in the second chamber 220. The spring 400 is provided between a spring stop 402 (attached to the inner wall of the jar cylinder assembly housing 204) and one surface of the operating piston 206. The remaining parts of the jarring tool 106 depicted in FIG. 9 are identical to the jarring tool 106 of FIG. 2.

The presence of the spring 400 increases application of axial force on the operating piston 206. This may be especially useful in scenarios in which the tension that can be applied on the carrier structure 112 is relatively limited, such as in scenarios of limited cable strength in deep wells, where the jarring tool 106 is positioned in a highly deviated or horizontal wellbore section, or in other scenarios.

In the embodiment of FIG. 9, the weight of the tool string above the jarring tool 106 is used to compress the spring 400 as the jar mandrel assembly 200 and rod assembly 210 are moved downwardly by the weight of the tool string above the jarring tool 106 into the jar cylinder assembly 202. The compression causes displacement of oil from the second chamber 220 into the first chamber 218. The spring 400, which is compressed, can apply an axial force in addition to the tension force developed in carrier structure 112 to cause movement of the operating piston 206 to the impact shoulder 270 of the jar cylinder assembly 204 when the jarring tool 106 is activated.

Figure 10:
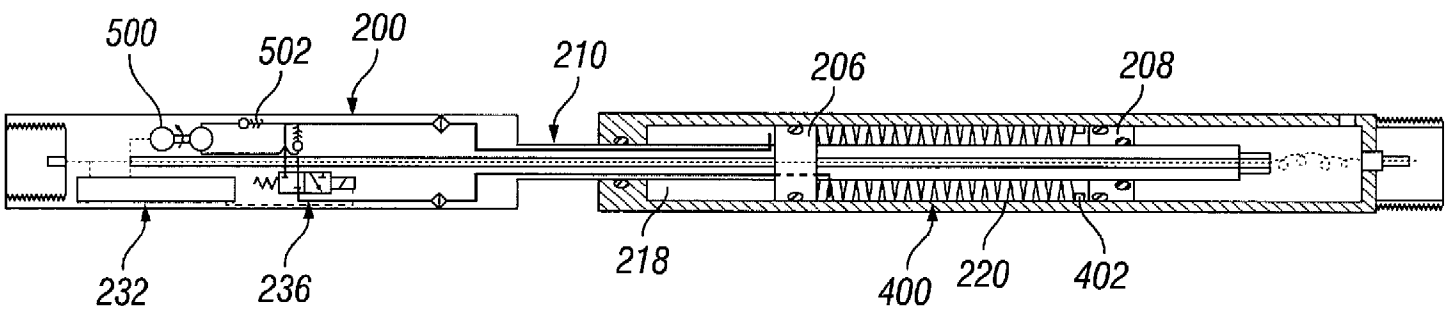

A further variation of the jarring tool 106 depicted in FIG. 9 is shown in FIG. 10, which further includes a hydraulic pump and motor assembly 500 in the jar mandrel assembly 200. The hydraulic pump and motor 500 can further increase the application of compression force on the spring 400 (in addition to the compression force applied by the weight of the tool string above the jarring tool 106). The hydraulic pump and motor 500 applies hydraulic pressure through a check valve 502 to push the operating piston 206 downwardly to compress the spring 400.

The above embodiments have depicted jarring tools that apply an impact force in the upward axial direction. In different variations, the impact force can be applied in the downward direction, or alternatively, in both the upward and downward directions. To do so, another spring can be added along with additional hydraulic circuits and control elements to enable movement of another piston against the jar cylinder assembly housing 204 in the downward direction.

Instead of using the spring 400 in the embodiments of FIGS. 9 and 10, a different embodiment would use a gas-charged accumulator to provide the additional axial force (instead of the spring 400) to augment the axial force applied on the operating piston. In yet further variations, other mechanical energy storage devices can be used to provide additional axial force on the operating piston 206.

Figure 11:
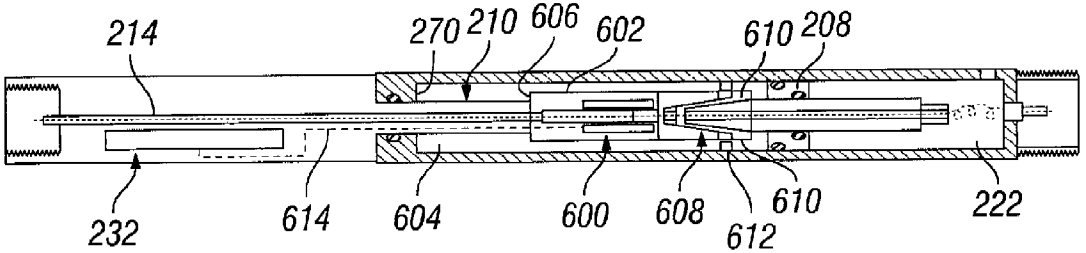

The various embodiments discussed above use a hydraulic mechanism that is triggered to cause movement of the operating piston 206 to cause application of an impact force. In a different embodiment, instead of using a hydraulic mechanism, a mechanical mechanism can be used, such as in the form of a linear actuator 600 as depicted in FIG. 11. The linear actuator 600 includes an outer housing 602, with the linear actuator positioned in a first chamber 604 inside the jar cylinder assembly housing 204. The first chamber 604 is defined between the compensation piston 208 and the upper part of the jar cylinder assembly housing 204. The outer housing 602 of the linear actuator 600 has an upper end 606 that is designed to collide with the impact shoulder 270 of the jar cylinder assembly housing 204 to apply the impact force.

The linear actuator 600 has a collet assembly 608 that has collet fingers 610 that protrude outwardly to engage a latch ring 612 that is attached to the inner wall of the jar cylinder assembly housing 204. When the collet fingers 610 are extended radially outwardly, as depicted in FIG. 11, the collet fingers 610 are engaged with the latch ring 612 to prevent axial movement of the linear actuator 600 inside the cylindrical bore of the jar cylinder assembly housing 204.

The linear actuator 600 is electrically connected to the electronic control module 232 over an electrical cable 614. In response to a command received over the through-wire conductor(s) 214, the electronic control module 232 issues an activation signal over the electrical cable 614 to the linear actuator 600, which causes the collet fingers 610 to retract radially inwardly such that the collet fingers 610 are no longer engaged with the latch ring 612. The linear actuator 600 is then free to move (due to tension applied to the carrier structure 112 or due to the presence of an energy storage device in the first chamber 604 that is engaged with the linear actuator 600) to cause its upper end 606 to impact the impact shoulder 270 of the jar cylinder assembly housing 204 to apply the impact force.

The linear actuator 600 can be selected from various electro-mechanical systems, including electro-mechanical systems that have a motor and power screws, a solenoid device, and so forth, that is able to operate the spring-loaded collet assembly 608 of the linear actuator 600.

Figure 12:
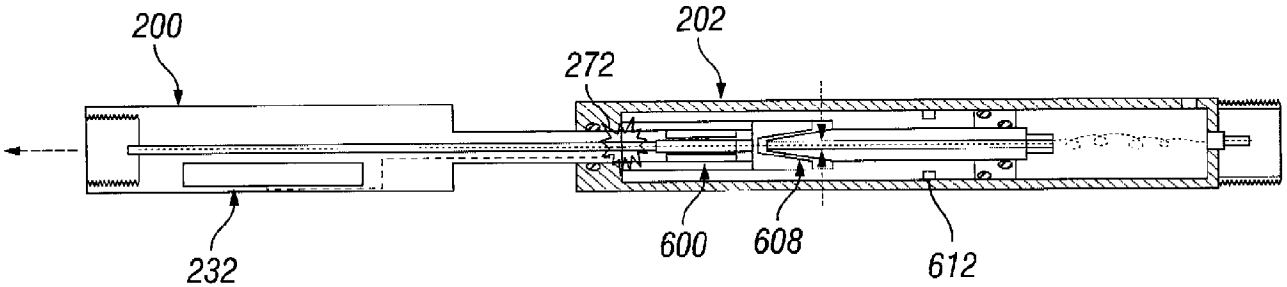

FIG. 11 shows the jarring tool in the retracted state, where the jar mandrel assembly 200 is in contact with the jar cylinder assembly 202. FIG. 12 shows the jarring tool in the extended position, after activation of the linear actuator 600 that allows the linear actuator 600 to move in the housing 204 to cause impact (272) with the inside of the housing 204.

Figure 13:
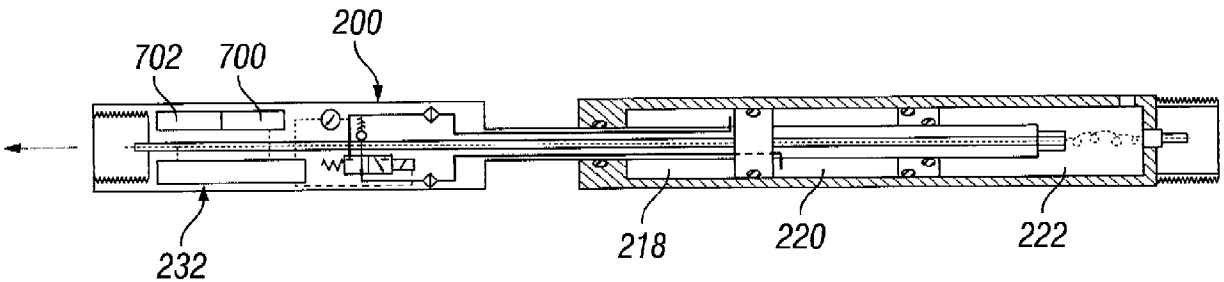

In some cases, it is possible that the electrical communication from the earth surface to the jarring tool 106 may fail, such as due to damage to the conductor(s) 214 depicted in the various embodiments above. To address this issue, as depicted in FIG. 13, a downhole power source 700 can be provided in the jar mandrel assembly 200 to provide power to various components of the jar mandrel assembly 200, such as the electronic control module 232 and the solenoid valve 236. Some nonlimiting examples of the downhole power source 700 include a battery, turbine, and so forth. In one example, battery power may be used if conveyed by wireline. On the other hand, if the carrier structure for the tool string is a drill pipe, then the power source 700 can be a turbine. In addition to the downhole power source 700, a sensor 702 can also be provided in the jar mandrel assembly 200, where the sensor 702 can be a strain sensor to detect application of tension on the tool string, or a pressure sensor to detect a pressure in the first chamber 218. Note that the pressure in the first chamber 218 is a function of the upward tension applied on the tool string.

The electronic control module 232 can be programmed to detect a threshold tension applied on the tool string (or alternatively, a predetermined pressure threshold). If the tension or pressure crosses a first threshold, then the jarring tool 106 can be armed. If the tension or pressure crosses a second threshold, then the jarring tool 106 can be activated.

If desired, timing delays can be programmed into the electronic control module 232, such that the jarring tool 106 can be operated in tandem with other jarring tools.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method for use in a well, comprising:

electrically activating a jarring tool to apply an impact force that is transmitted to at least another tool in the well, wherein electrically activating comprises communicating at least one command from a wellbore surface over at least one electrical conductor along a wireline to the jarring tool; and operating a hydraulic mechanism in response to the electrical activation of the jarring tool to cause a first member of the jarring tool to be moved to collide with a second member of the jarring tool to apply the impact force, wherein operating the hydraulic mechanism comprises opening a solenoid valve in the hydraulic mechanism in response to electrical activation of the jarring tool, wherein opening the solenoid valve allows for hydraulic fluid to flow between chambers of the jarring tool to allow movement of the first member, the hydraulic mechanism and the solenoid valve disposed within the first member.

2. The method of claim 1, further comprising an electronic control module responding to the electrical activation by operating the hydraulic mechanism.

3. The method of claim 1, further comprising applying a tensile force on the wireline attached to a tool string that includes the jarring tool, wherein electrically activating the jarring tool is after application of the tensile force on the wireline, wherein the tensile force determines a magnitude of the impact force applied by the jarring tool.

4. The method of claim 3, wherein applying the tensile force comprises applying a tensile force selected from plural possible tensile forces, wherein the selected tensile force is based on a target impact force to be applied by the jarring tool.

5. The method of claim 1, wherein the jarring tool includes an external housing and an inner bore that includes an operating piston, wherein electrically activating the jarring tool causes the piston to move inside the inner bore of the jarring tool to impact an impact surface of the external housing.

6. The method of claim 5, further comprising providing an energy storage source in the jarring tool, wherein the energy storage source is provided to apply a force on the operating piston to move the operating piston.

7. The method of claim 6, wherein providing the energy storage source comprises providing one of a spring and a gas-charged accumulator.

8. The method of claim 7, further comprising providing a motor and pump assembly to compress the energy storage source.

9. The method of claim 5, wherein the inner bore has a first portion having a first diameter and a second portion having a second, greater diameter, wherein the operating piston is positioned in the portion of the inner bore with the first diameter prior to activation of the jarring tool, the method further comprising:

moving the operating piston into the portion of the inner bore having the second diameter during activation of the jarring tool such that bypass of fluids is enabled around the operating piston to accelerate a speed of movement of the operating piston.

10. The method of claim 5, further comprising providing a floating piston in the inner bore of the external housing, wherein the floating piston provides compensation for fluid expansion or contraction due to variation in temperature and pressure.

11. The method of claim 1 wherein the first member and second member are slidable with respect to each other, wherein the first member and second member are initially in a retracted position having respective ends in contact, and wherein opening of the solenoid valve allows the first member to extend away from the second member.

12. The method of claim 11 wherein the jarring tool is hydraulically locked in the retracted position.

13. A jarring tool for use in a well, comprising:

a module responsive to electrical activation from an electrical command communicated from a surface of the well over at least one conductor in a wireline to which the jarring tool is coupled;

a first member moveable in response to signaling from the module that is responsive to the electrical activation, the first member comprising a hydraulic mechanism for providing the movement, the hydraulic mechanism comprising a solenoid valve for controlling fluid flow thereto in response to the electrical activation;

an impact member against which the first member collides to apply an impact force that is transmitted to at least one other tool for jarring the at least one other tool, the hydraulic mechanism and the solenoid valve disposed within the first member.

14. The jarring tool of claim 13, wherein movement of the first member is enabled by a tensile force applied to the wireline to which the jarring tool is coupled.

15. The jarring tool of claim 14, wherein the hydraulic mechanism is activated by the signaling from the module.

16. The jarring tool of claim 13, further comprising an energy storage source in the housing, the energy storage source to apply a force on the first member for moving the first member upon activation of the hydraulic mechanism to allow movement of the first member.

17. The jarring tool of claim 13, further comprising:

a housing in which the first member is moveably positioned, wherein the first member divided an inner bore of the housing into a first chamber and a second chamber; and wherein the hydraulic mechanism enables communication of fluid between the first and second chambers to allow movement of the first member in the inner bore.

18. A tool string for use in a well, comprising:

a first tool;

a jarring tool coupled to the first tool, the jarring tool responsive to at least one command for electrical activation by applying an impact force that is communicated to the first tool to free the first tool from a stuck position in the well, the jarring tool comprising a first assembly and a second assembly that are slidable with respect to each other, wherein the first assembly and second assembly are initially in a retracted position having respective ends in contact, and wherein opening of a solenoid valve disposed within the first assembly allows the first assembly to extend away from the second assembly; and a wireline coupled to the first tool and jarring tool, wherein prior to activation of the jarring tool, a tensile force is applied to the wireline, wherein the tensile force applied to the wireline defines the impact force applied by the jarring tool, wherein the impact force is applied in the same direction as the tensile force, wherein the at least one command is sent from an earth surface of the well along the wireline to the jarring tool.

* * * * *